US006549089B2

(12) United States Patent
Ashoka

(10) Patent No.: US 6,549,089 B2
(45) Date of Patent: Apr. 15, 2003

(54) MICROSTRIP DIRECTIONAL COUPLER LOADED BY A PAIR OF INDUCTIVE STUBS

(75) Inventor: Halappa Ashoka, Queensland (AU)

(73) Assignee: Filtronic Pty Ltd., Murarrie (AU)

( * ) Notice: Subject to any disclaimer, the term of this patent is extended or adjusted under 35 U.S.C. 154(b) by 0 days.

(21) Appl. No.: 09/904,687

(22) Filed: Jul. 13, 2001

(65) Prior Publication Data

US 2003/0011442 A1 Jan. 16, 2003

(51) Int. Cl.[7] ..... H01P 5/18

(52) U.S. Cl. ..... 333/116; 333/117; 333/112; 333/115

(58) Field of Search ..... 333/116, 109, 333/112, 115, 117

(56) References Cited

U.S. PATENT DOCUMENTS

| | | | | |
|---|---|---|---|---|
| 4,394,630 A | * 7/1983 | Kenyon et al. | ..... | 333/116 |
| 5,159,298 A | * 10/1992 | Dydyk | ..... | 333/116 X |
| 5,539,362 A | * 7/1996 | Culling | ..... | 333/116 |
| 6,128,478 A | * 10/2000 | Kim | ..... | 455/116 |

FOREIGN PATENT DOCUMENTS

| | | | | |
|---|---|---|---|---|
| JP | 54-51446 | * 4/1979 | ..... | 333/112 |
| JP | 56-62402 | * 5/1981 | ..... | 333/116 |
| JP | 56-138302 | * 10/1981 | | |
| JP | 63-263801 | * 10/1988 | | |
| JP | 2000-77915 | * 3/2000 | | |

OTHER PUBLICATIONS

Dydyk, M.; "Microstrip Directional Couplers With Ideal Performance via Single–Element Compensation", *IEEE Transactions of Microwave Theory and Techniques;* vol. 47, Issue 6, Part 2, pp. 956–964, Jun., 1999.*

A. Podell, "A High Directivity Microstrip Coupler Technique", 1970–MTT–Symposium Digest, May 1970, pp 33–36.

T. Sugiura, "Analysis of Distributed–Lumped Strip Transmission Lines", IEEE Tarns. Microwave Theory and Tech., vol.MTT–25, Aug. 1977, pp. 656–661.

* cited by examiner

*Primary Examiner*—Barbara Summons
(74) *Attorney, Agent, or Firm*—Katten Muchin Zavis Rosenman

(57) ABSTRACT

A microstrip side-coupled directional coupler (20) uses inductive loading to achieve improved directivity. In one embodiment, short-circuited inductive stubs (26, 27) are connected to the coupled line (22) of the coupler (20). In a second embodiment, pairs of short circuited inductive stubs (34, 35) are connected respectively to the coupled line (32) and the primary transmission line (35) of a directional coupler (30). In a third embodiment, the primary transmission line (41) and the coupled line (42) of a coupler (40) are both centre loaded with short-circuited inductive stubs (43, 44) respectively.

10 Claims, 2 Drawing Sheets

MICROSTRIP DIRECTIONAL COUPLER LOADED BY A PAIR OF INDUCTIVE STUBS

This invention relates to an improved microstrip directional coupler. In particular, the invention is directed to a microstrip directional coupler which uses inductive loading to improve directivity.

BACKGROUND ART

A directional coupler is used to couple a secondary transmission path to a wave travelling in one direction on a primary transmission path. The secondary transmission path normally has two ports, namely a coupled port which receives a small amount of energy from the wave on the primary transmission path, typically 10 to 20 dB less than that in the primary transmission path, and an isolated port which ideally does not receive any of the coupled energy.

Implementation of directional couplers in microstrip transmission line medium has a number of advantages over other media. These include compact size, simple printed circuit board fabrication techniques, ability to be integrated with other circuitry with no additional mechanical construction techniques, and ease of design using analytical or computer-aided design methods.

However, the traditional microstrip coupler has a poor directivity, which is defined as the ratio of desired power at the coupled port to the undesired power at the isolated port. This stems from the fact that the fields in the microstrip medium exist in two different dielectrics i.e. the air and the substrate. This leads to the even mode fields, which are confined to the substrate, being slower than the odd mode fields, which are partially in the air. The even and odd modes thus do not cancel in the reverse direction, leading to poor directivity.

For example, a traditional quarter-wave long coupled line microstrip directional coupler on 0.787 mm thick Tac-Lam TLY5 substrate provides about 15 dB directivity for a 10 dB coupler, about 8 dB directivity for a 20 dB coupler, and about 5 dB for a 30 dB coupler for a 5% operating bandwidth. In many power monitoring applications, such values are unacceptable as they introduce errors in the system performance.

A number of attempts have been made over the last three decades to overcome this limitation of the microstrip couplers. Podell [A. Podell, "A High Directivity Microstrip Coupler Technique", 1970-MTT-Symposium Digest, May 1970, pp 33–36.] used a wiggly gap in the coupling region between the main and coupled lines to increase the path travelled by the odd modes to achieve better directivity. Such design is empirical and cannot be easily analysed. Sugiura [T. Sugiura, "Analysis of Distributed-Lumped Strip Transmission Lines", IEEE Tarns. Microwave Theory and Tech., vol.MTT-25, pp. 656–661.] has attempted to analyse a similar technique to slow down the odd mode using "distributed-lumped" transmission lines. However, only theoretical results for coupled lines were presented.

Other ways to slow down the odd modes include capacitively loading the odd mode at the ends [G. Schaller, "Optimnisation of Microstrip Directional Couplers with Lumped Capacitors", A.E.U.Vol.31, July-August 1977, pp 301–307.], or at the middle of the coupler by connecting capacitors between the main line and the coupled lines. Although these techniques give good directivity, they require very small values of capacitance (of the order of a fraction of a picofarad). These capacitors can be realised by small double-sided copper on substrates, cut into small squares placed vertically and soldered to the main and coupled lines. They have to be positioned precisely in order to obtain the best performance. In addition, they increase the coupling, so that their effect has to be included at the design stage. Some iteration may still be necessary.

A simple method to improve directivity is to make the coupler considerably shorter than the usual quarter-wave length. Couplers that are an eighth of a wavelength long provide abut 10 dB improvement in directivity. However, the coupling varies over the band of operation considerably, and is not acceptable except in very narrow-band and less stringent applications. In addition, the coupling gap has to be reduced to compensate for the lower coupling due to shortened coupling length.

U.S. Pat. No. 5,159,298 discloses a microstrip directional coupler which uses a single lumped element compensator, such as a capacitor or inductor, connected between the two conductors which define the primary and secondary transmission paths of the coupler, in order to improve directivity. However, the described directional coupler requires the use of non-planar cross-over fabrication techniques, and is therefore suitable only for microwave integrated circuit (MIC) and monolithic microwave integrated circuit (MMIC) applications.

It is an object of this invention to provide an improved microstrip directional coupler which overcomes or ameliorates one or more of the abovedescribed disadvantages.

SUMMARY OF THE INVENTION

The microstrip directional coupler of this invention uses inductive loading to achieve improved directivity.

The directional coupler is generally of conventional form having a dielectric substrate layer, a planar conductive layer on one side of the substrate layer which, in use, may serve as a ground plane, and first and second planar conductive strips laid on the other side of the substrate, the second conductive strip being electromagnetically coupled to the first conductive strip in use. The second (or coupled) conductive strip has a coupling section which is positioned side-by-side with the first conductive strip. The ends of the coupling section are connected respectively to a coupled port and an isolated port by transmission line sections of the conductive strip.

In one embodiment of the invention, the second conductive strip is inductively loaded to ground by a pair of inductive stubs, each connected to a respective one of the transmission line sections. Each inductive stub is a planar conductive strip on the substrate less than one quarter wavelength long at the operating frequency of the coupler, the end of the strip being connected through the substrate to the ground plane. The inductive stubs are designed to reflect a small amount of power from the coupled port to the isolated port to achieve phase cancellation, thereby improving directivity.

In a second embodiment, a pair of inductive stubs are connected to respective opposite ends of the coupling section of the second conductive strip. Another pair of inductive stubs are respectively connected to the first conductive strip at locations adjacent the ends of the coupling section of the second conductive strip. The stubs are short-circuited to the ground plane, and provide inductive loading for the even modes.

In a variation of the second embodiment, the even mode is inductively loaded in the middle of the coupled section by short-circuited inductive stubs connected respectively to the first and second conductive strips.

Although planar strip-like inductive stubs are preferred for ease of fabrication, lumped element inductances may alternatively be used.

In order that the invention may be more fully understood and put into practice, preferred embodiments thereof will now be described by way of example, with reference to the accompanying drawings.

DESCRIPTION OF PREFERRED EMBODIMENTS.

Figure 1:
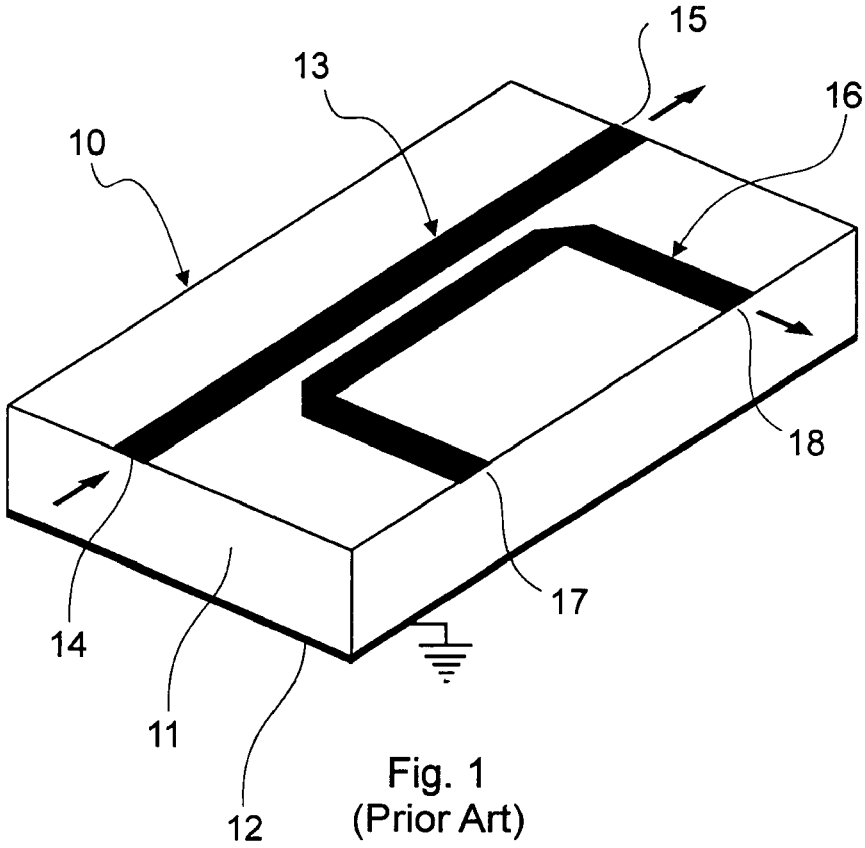
Fig. 1 (Prior Art)
FIG. 1 is a schematic perspective view illustrating the configuration of a conventional microstrip directional coupler.

FIG. 1 illustrates a conventional microstrip coupled-line directional coupler 10. The coupler comprises a dielectric substrate 11 having a conductive layer 12 on the bottom thereof. In use, the conductive layer 12 is connected to earth and serves as a ground plane.

A first microstrip transmission line is formed by a strip conductor 13 on the substrate, extending from an input port 14 to an output port 15. (For clarity, the port connectors are omitted). A second transmission line is formed by a second strip conductor 16 on the substrate extending between ports 17 and 18. The second transmission line 16 has a portion which is parallel to the first transmission line 13, and spaced closely thereto.

In use, a portion of the wave energy travelling from the input port 14 to the output port 15 of the first transmission line 13 is coupled to the second transmission line 16 and is available at port 17 ("the coupled port"). Ideally, there is no energy transfer in the other direction and none of the coupled energy appears at port 18 ("the isolated port"). (For wave energy travelling in the opposite direction, i.e. from port 15 to port 14 of the transmission line 13, the coupled energy appears at port 18, while port 17 remains isolated). The function and construction of such microstrip directional couplers are well known in the art and need not be described further in this patent specification.

Figure 2:
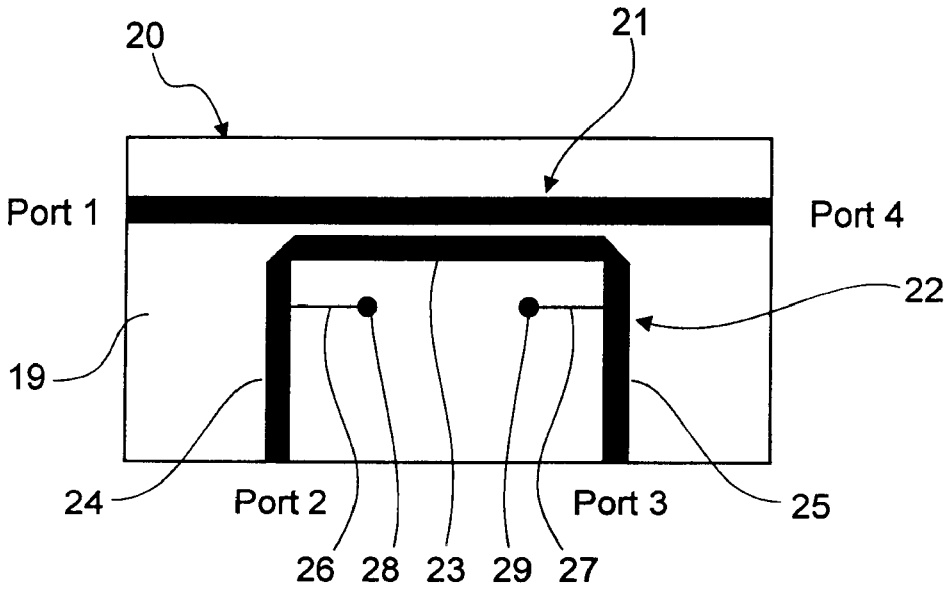
FIG. 2 is a plan view of a microstrip directional coupler according to a first embodiment of the invention.

A first embodiment of the invention is illustrated in FIG. 2. The microstrip directional coupler 20 of FIG. 2 is similar to the conventional coupler of FIG. 1, and has a first (or primary) transmission line 21 which is coupled to a second (or coupled) transmission line 22. Both transmission lines 21, 22 are thin conductive strips laid on a dielectric substrate 19. The secondary transmission line has a coupled section 23 located adjacent the primary transmission line 21 and parallel thereto. The coupled sectional 23 is connected to port 2 and port 3 by respective transmission line sections 24, 25.

In the coupler 20, short-circuited stubs 26, 27 are connected to the respective transmission line sections 24, 25, as shown in FIG. 2. Each stub 26, 27 consists of a thin conductive strip laid on the substrate 19. The distal end of each stub is connected to the ground plane (not shown), typically by a plated through-hole 28, 29 in the substrate 19. The length of each stub 26, 27 is less than a quarter of the wavelength at the operating frequency, so that each stub acts as an inductance.

The short-circuited stubs 26, 27 in the coupled line 22 are used to reflect a portion of the coupled signal, to achieve phase cancellation. That is, a small amount of power from the coupled port is reflected, with opposite phase, to the isolated port in order to achieve the cancellation. The phase cancellation at the isolated port therefore increases directivity. Since only a small amount of power needs to be reflected back to the isolated port, the return loss on the coupled port is not affected significantly.

The position and length of the stubs 26, 27 can be optimised using CAD techniques. The circuit between the end of the coupled line and the stubs can be selected to optimise the performance of the coupler from space considerations. For example, instead of a 50 ohm line connecting the ends of the coupled line 22 to the stubs 26, 27, a line of different impedance can be chosen to optimise the coupler design.

A 20 dB coupler was designed for operation over a 6% bandwidth at a centre frequency of 1842.5 MHz. The substrate used was Tac-Lam TLY5 with a dielectric constant of 2.2 and thickness of 0.87 mm. A directivity value of 30 dB was obtained for the 20 dB coupler, without sacrificing the return loss performance significantly.

Figure 3:
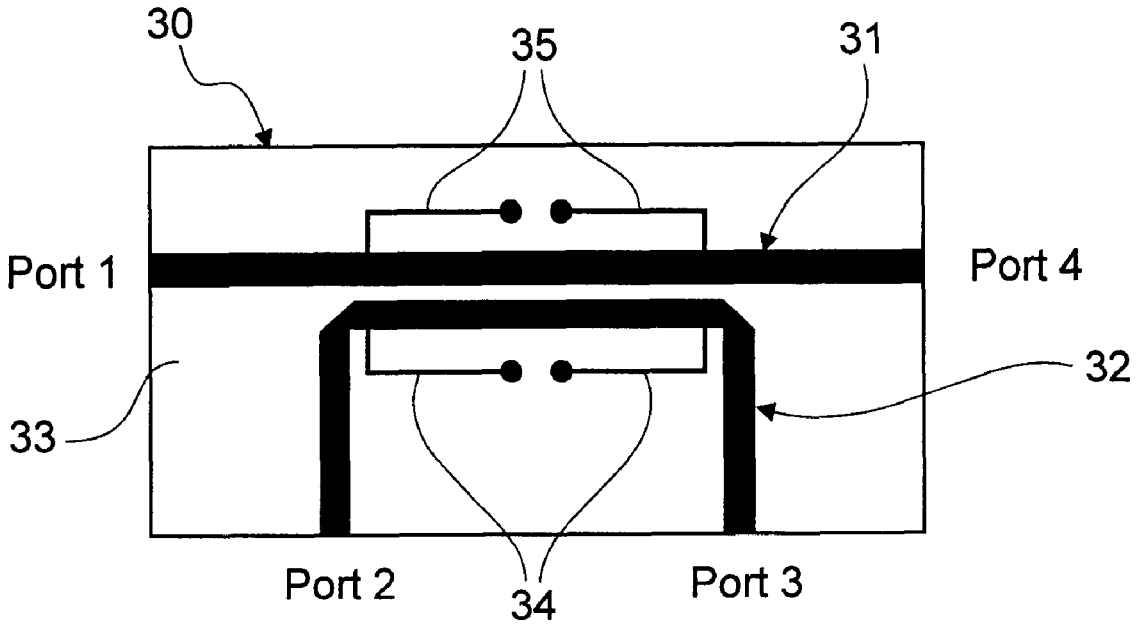
FIG. 3 is a plan view of a microstrip directional coupler according to a second embodiment of the invention.

A second embodiment of the invention is illustrated in FIG. 3. In this embodiment, a side-coupled directional coupler 30 has a primary transmission line 31 and a coupled transmission line 32 laid on a substrate 33 having a ground plane, in the conventional manner.

As in the previous embodiment, the coupled line 32 has a coupled section juxtaposed with the primary transmission line 31, the coupled section being connected to the coupled and isolated ports by short lengths of strip line.

The coupler also has a first pair of short-circuited stubs 34 connected to opposite ends of the coupled section of the coupled line 32. A second pair of short-circuited stubs 35 are connected to the primary transmission line 31 at spaced locations, corresponding to the connections of the stubs 34 to the coupled line 32. Each stub 34, 35 is short-circuited by having its distal end connected to the ground plane, e.g. by a plated throughhole in the substrate 33.

In the coupler 30 of FIG. 3, the stubs 34, 35 provide inductive loading of the ends of the coupled sections of the primary and coupled transmission lines, for the even modes. The inductive loading is optimised using standard CAD methods for improved directivity. Unlike prior art methods in which capacitive loading of the odd modes is used, the coupler 30 of FIG. 3 uses even-mode end loading to achieve improved directivity.

Although short-circuited stubs are used for the inductive loading in the illustrated embodiment, the inductive loading can also be realised using lumped inductances to ground if space does not permit the use of the inductive stubs.

A 20 dB coupler of the type shown in FIG. 3 was fabricated on Tac-Lam TLY5 substrate. Experimental results revealed that this coupler gave better return loss on the coupled ports than the coupler 20 of FIG. 2, while the achieved directivity was comparable. The coupler 30 of FIG. 3 however, required slightly larger substrate area than the coupler 20.

The microstrip line directional couplers of FIGS. 2–3 have several advantages over conventional directional couplers, including:

- Being fully planar, the couplers can be easily fabricated using simple standard printed circuitboard techniques without overlays (unlike the capacitor loaded types and the overlay types).
- The couplers can be easily analysed using standard computer-aided-design (CAD) techniques (unlike the wiggly line couplers).

The couplers can be easily integrated into a subsystem that uses microstrip line components.

Improved directivity is achieved.

The foregoing describes only some embodiments of the invention, and modifications which are obvious to those skilled in the art may be made thereto without departing from the scope of the invention as defined in the following claims.

For example, lumped element conductors can be used for the inductive loading instead of printed inductive lines. Matching circuits at the different ports of the coupler can also be used to improve return loss performance, and to reduce the size of the circuit.

What is claimed is:

1. A microstrip directional coupler comprising:

a dielectric substrate layer, a planar conductive layer on one side of the substrate layer which, in use, serves as a ground plane, first and second planar conductive strips on the other side of the substrate, the second conductive strip has a pair of ports, a coupling section juxtaposed with, and operatively coupled to, the first conductive strip, and a pair of transmission line sections, each transmission line section being connected between a respective end of the coupling section and a respective port, and wherein the second conductive strip is inductively loaded by a pair of inductive stubs, each connected to a respective one of the transmission line sections.

2. A coupler as claimed in claim 1, wherein each inductive stub comprises a planar conductive strip on the substrate layer, less than one quarter wavelength long at the operating frequency of the coupler.

3. A coupler as claimed in claim 2, wherein each inductive stub is short-circuited by having the distal end of its conductive strip electrically connected to the planar conductive layer.

4. A coupler as claimed in claim 1, wherein each inductive stub comprises a lumped element inductor.

5. A microstrip directional coupler comprising:

a dielectric substrate, first and second conductive strips laid on one surface of the substrate, the second conductive strip being electromagnetically coupled to the first conductive strip in use, wherein the second conductive strip is inductively loaded by a pair of inductive stubs, each inductive stub being a conductive strip laid on the substrate and having its end connected to ground.

6. A coupler as claimed in claim 5, wherein the first conductive strip is inductively loaded by a pair of inductive stubs, each of which comprises a conductive strip laid on the substrate and having its distal end connected to ground.

7. A microstrip directional coupler comprising:

a dielectric substrate layer, a planar conductive layer on one side of the substrate layer which, in use, serves as a ground plane, first and second planar conductive strips on the other side of the substrate, the second conductive strip has a pair of ports, a coupling section juxtaposed with, and operatively coupled to, the first conductive strip, and a pair of transmission line sections, each transmission line section being connected between a respective end of the coupling section and a respective port, and wherein the second conductive strip is inductively loaded by a pair of inductive stubs connected to respective opposite ends of the coupling section of the second conductive strip, and the first conductive strip is inductively loaded by a pair of inductive stubs respectively connected to the first conductive strip at locations adjacent the ends of the coupling section of the second conductive strip.

8. A coupler as claimed in claim 7, wherein each inductive stub comprises a planar conductive strip on the substrate layer, less than one quarter wavelength long at the operating frequency of the coupler.

9. A coupler as claimed in claim 8, wherein each inductive stub is shortcircuited by having the distal end of its conductive strip electrically connected to the planar conductive layer.

10. A coupler as claimed in claim 7, wherein each inductive stub comprises a lumped element inductor.

* * * * *